United States Patent [19]

Rinke

[11] Patent Number: 5,044,465

[45] Date of Patent: Sep. 3, 1991

[54] RETRACTABLE WALK-IN SWIMMING POOL LADDER

[76] Inventor: Robert M. Rinke, 2201-33 Ave. S., Fargo, N. Dak. 58104

[21] Appl. No.: 603,513

[22] Filed: Oct. 29, 1990

[51] Int. Cl.[5] ..... E06C 9/08

[52] U.S. Cl. ..... 182/97; 182/91; 182/106

[58] Field of Search ..... 182/97, 99, 93, 106, 182/150, 91; 114/362

[56] References Cited

U.S. PATENT DOCUMENTS

| | | | |
|---|---|---|---|
| 3,731,761 | 5/1973 | Glenn | 182/97 |
| 3,973,646 | 8/1976 | Martinez | 182/97 |
| 4,316,524 | 2/1982 | Lapeyre | 182/106 |
| 4,716,987 | 1/1988 | Lindberg | 182/97 |
| 4,768,618 | 9/1988 | Ritten | 182/97 |
| 4,813,514 | 3/1989 | Lathers | 114/362 |

*Primary Examiner*—Reinaldo P. Machado

[57] ABSTRACT

A retractable walk-in swimming pool ladder includes a platform having side frames secured thereto. A plurality of steps extended between and are secured to the side frames. A first pair of rollers are journaled on the platform and a second pair of rollers are journaled on the side frames adjacent the lowermost step. Linkages pivotally connect the platform to the swimming pool deck and cooperate with the rollers to permit the swimming pool ladder to be readily retracted from and returned to the swimming pool.

4 Claims, 1 Drawing Sheet

RETRACTABLE WALK-IN SWIMMING POOL LADDER

FIELD OF THE INVENTION

This invention relates to swimming pool ladders and more particularly to retractable walk-in swimming pool ladder.

BACKGROUND OF THE INVENTION

Typically, residential type and institutional type swimming pools are provided with steps or ladders to facilitate entry into and exit from a swimming pool. Walk-in type swimming pool steps are preferred by older persons, handicapped persons, and children since walk-in swimming pool steps provide a greater degree of stability to the user. Most swimming pool steps or ladders are anchored to the swimming pool and cannot be readily retracted to accommodate pool cleaners, retractable pool covers, solar blankets or to clear a swimming lane.

SUMMARY OF THE INVENTION

An object of this invention is the provision of a novel retractable walk-in swimming pool ladder which facilitates entry into and exit from a swimming pool but which may be readily retracted from the swimming pool to accommodate pool cleaners, retractable pool covers, solar blankets or to clear the swimming lane.

The novel retractable swimming ladder includes a platform which is secured to the swimming pool deck by linkage. Side frames are rigidly secured to the platform and to a plurality of steps which descend into the pool. Rollers on the platform and on the side frames permit the walk-in ladder to be completely retracted from the swimming pool as the linkage is extended. The swimming pool ladder may be again placed into the pool by merely rolling the steps into the pool as the linkage is folded.

FIGURES OF THE DRAWING

DESCRIPTION OF THE PREFERRED EMBODIMENT

Figure 1:
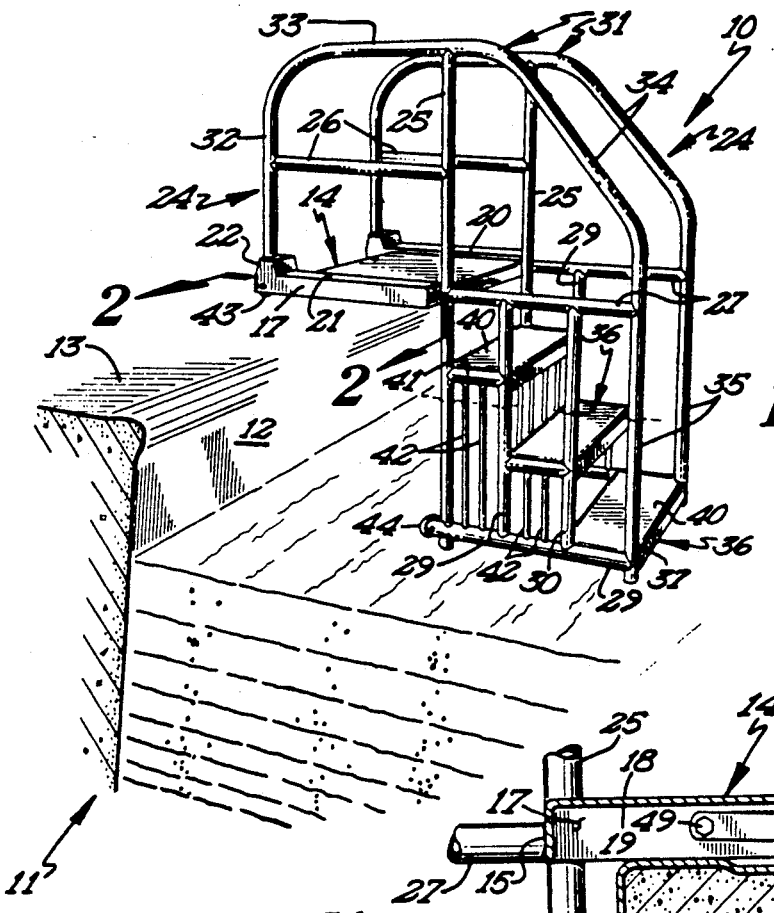
FIG. 1 is a perspective view of the novel swimming pool ladder illustrated in the normal operative position of use in a swimming pool.
Figure 2:
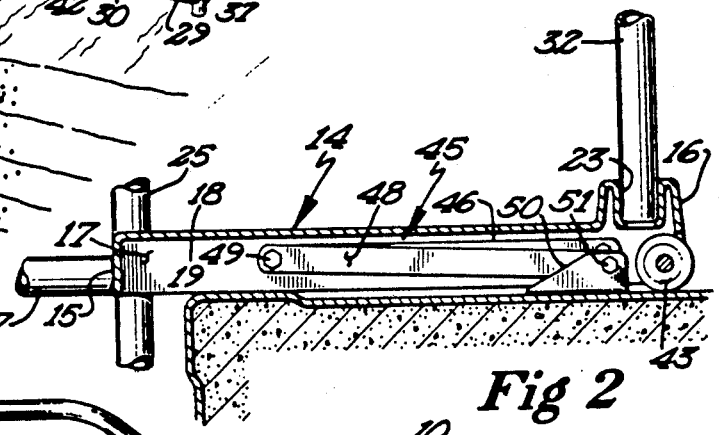
FIG. 2 is a cross-sectional view taken approximately along line 2—2 of FIG. 1 and looking in the direction of the arrows and, FIG. 3 is a cross-sectional view of the swimming pool ladder illustrating the latter in the retracted position.

Referring now to the drawings and more specifically to FIG. 1, it will be seen that the novel retractable walk-in swimming pool ladder, designated generally by the reference numeral 10, or thereshown. The swimming pool ladder 10 is illustrated in FIG. 1 in the operative position with respect to a swimming pool 11. The swimming pool 11 is of conventional design and construction and includes vertical walls such as the vertical wall 12. The swimming pool is provided with a horizontal peripheral deck or surface 13 adjacent the vertical walls thereof. The swimming pool ladder includes a rectangular shaped platform 14 having a depending front flange 15, a depending rear flange 16, and depending side flanges 17. These depending flanges define the front rear and side edges respectively of the platform.

The platform 14 also includes a substantially flat planar upper surface 18 and a lower surface 19. The upper surface of the platform includes vertically off set surface portions 20 that are integral with off set horizontal surface portions 21. The off set horizontal surface portions are integral with the depending side flanges 17 of the platform. The platform also has a pair of socket defining members 22 integrally formed with the rear corners thereof, each socket defining member 22 presenting a vertically facing socket 23.

The walk-in pool swimming pool steps also includes a pair of substantially identical side frames 24 each including a plurality of vertical frame members and a plurality of horizontal frame members. Each side frame includes an elongate vertical frame member 25 which is rigidly secured to the depending front flange of the platform 14 and which is rigidly affixed to the front end of an upper horizontal frame member 26. The side frames 24 frame member 25 for each said frame is also rigidly secured to the rear end of an intermediate horizontal frame member 27 and a lower horizontal frame member 28 The intermediate and lower horizontal frame members are rigidly secured together by a vertical frame member 29 and a vertical frame member 30 which are disposed in substantially parallel relation with respect to each other and are parallel to the vertical frame member 25.

Each side frame 24 also includes an elongate handrail 31. Each handrail 34 includes an upper vertical portion 32 having its lower end positioned in one of the sockets 23 of a socket defining member 32 and projecting upwardly therefrom. This vertical portion 32 of each handrail is also rigidly secured to the rear end of the upper horizontal frame member 26. Each handrail also includes horizontal portion 32 is rigidly secured to the vertical frame member 25 which is integral with a downwardly inclined portion 34. The downwardly inclined portion of each handrail terminates in a lower vertical portion 35 which is rigidly secured to the intermediate horizontal frame member 27 and the lower horizontal frame element 28. It will be noted that the horizontal portion 33 of each handrail is disposed in substantially parallel relation with the platform 20.

The swimming pool ladder 10 also include a plurality of rectangular shaped horizontal steps 36 that progressively descend from adjacent the platform in a downwardly direction. Each step includes a depending front flange 37, a depending rear flange 38 and depending side flanges 39. Each step also has a substantially flat upper surface 40 which is disposed in substantially parallel relation with respect to the platform 14. The lowermost step 36 has the depending flanges thereof rigidly secured to the lower horizontal frame member 28 and to the vertical portion of the handrail 31. The other horizontal steps 36 have round stock elements 41 rigidly secured to their respective depending side flanges and these round stock elements are rigidly secured to the vertical frame members. It will also be noted that small vertical frame elements 42 extend between round stock elements 41 and the lower horizontal frame member 28 to add stability to the swimming pool ladder.

It is pointed out that the entire swimming pool may be formed of a suitable high strength light weight plastic material. When the swimming pool ladder is formed of such high strength light weight plastic material, the side frames may each be moulded as a unit and then may be secured to the platform and to the steps by well known plastic welding means. It is further pointed out that all of the components of the side frames 24 are preferably of circular cross-sectional configuration.

The swimming pool ladder 10 is provided with a pair of upper rollers 43 each being journaled on the platform adjacent the rear corners thereof. Specifically, the rollers 43 are journaled in opposed wall elements of the socket defining members 22. The rear end of the lower horizontal frame member 28 for each side frame 24 is also provided with a roller which is journaled thereon. With this arrangement, when the swimming pool ladder 10 is disposed in the operative position within the swimming pool, as illustrated in FIG. 1, the rollers 44 will engage the vertical wall of the swimming pool while the rollers 43 will engage the deck 18 of the swimming pool.

Figure 3:
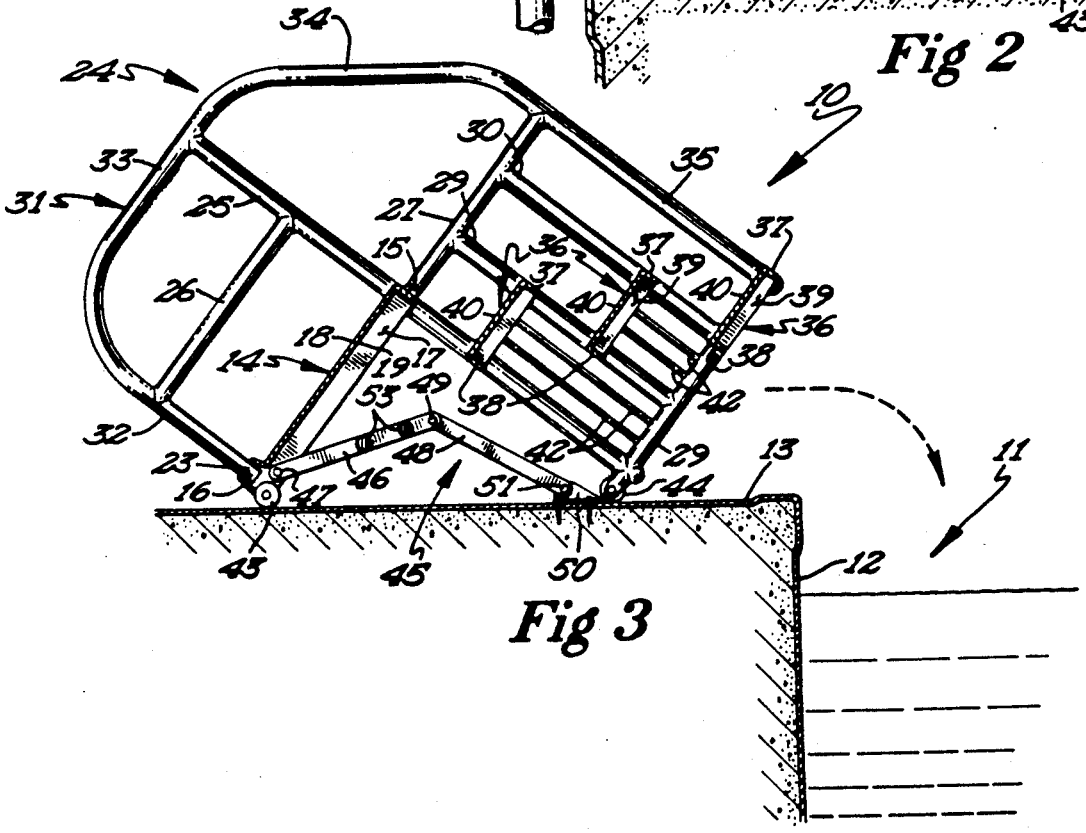

Means are provided for anchoring the swimming pool ladder to the swimming pool but permitting retraction of the swimming pool ladder from the operative position illustrated in FIG. 1 to the retracted position illustrated in FIG. 3. This means includes a pair of retraction linkages 45, each linkage including an elongate substantially straight link 46 having one end thereof pivotally connected to one of the depending side flanges 17 of the platform by pivot 47. The other end of each link 46 is pivotally connected to one end of an elongate substantially straight link 48 by pivot 49. The other end of the link 48 for each linkage is pivoted to one of a pair of anchoring brackets 50 by pivot 51. Each bracket 50 is secured to the deck by suitable bolts 52. Stiffening rods 53 extend between and rigidly interconnect the links 46 of the linkages 45.

When the swimming pool ladder are disposed in the operative position as illustrated in FIG. 1, the links 46 and 48 of each linkage will be folded in side by side relation to the position illustrated in FIG..2. However, when it is desirable to retract the swimming pool ladder from the swimming pool, the handrails of the side frames may be gripped and pulled upwardly and rearwardly by a user so that the rollers 43 and 44 will roll to the position illustrated in FIG. 3. When the ladder are completely retracted as illustrated in FIG. 3, the linkages 45 will be disposed in the position illustrated in FIG. 3. In this position, the linkages are not fully extended but are sufficiently extended to retain the ladder in the retraced position. When it is desirable to again place the ladder in the operative position, the user will merely push the ladder towards the pool edge and allow the swimming pool steps to move to the position illustrated in FIG. 1.

The swimming pool ladder is adapted for use with residential swimming pools as well as public and institutional swimming pools. The high strength light weight plastic construction of the walk-in swimming pool ladder permits the ladder to be readily removed from and readily returned to a swimming pool. The linkage mechanisms provide means for quickly attaching the ladder to a desired location but the linkage mechanisms also permits relocation of the swimming pool ladder with a minimum of effort.

Thus it will be seen that I have provided a novel walk-in swimming pool ladder which is not only of simple and inexpensive construction, but one which functions in a more efficient manner than any heretofore comprable ladder.

What is claimed is:

1. A retractable swimming pool ladder for use with swimming pools having vertical walls and an exterior deck, comprising;

a generally rectangular, substantially flat platform having front, rear and side edges, a first pair of rollers journaled on said platform adjacent the rear edge thereof, a pair of parallel substantially identical side frames secured to said platform adjacent the side edges thereof, said side frames each including a plurality of vertical and horizontal frame members, a pair of side rails each being secured to vertical and horizontal frame members of one of said side frames, a plurality of vertically spaced apart rectangular shaped steps extending between and secured to said side frames, a second pair of rollers each being journaled on one of said side frames, a foldable and extensible linkage means pivotally connected to said platform and pivotally connected to the deck, said linkage means being disposed in a folded condition when the swimming pool ladder is in a normal operative position, and being extended when the swimming pool ladder is in a retracted position, said first and second pairs of rollers respectively engaging the deck and a vertical wall of the swimming pool in rolling engagement therewith during shifting movement of the swimming pool ladder to a retracted position, and cooperating with said linkage means to position the swimming pool ladder completely on the deck exteriorly of the pool when the swimming pool ladder is in the retracted position.

2. The swimming pool ladder as defined in claim 1 wherein said linkage means includes a pair of linkages each including an elongate first link having one end thereof pivotally connected to said platform, an elongate second link having one end thereof pivotally connected to said first link and having the other end thereof pivotally connected to an anchoring bracket secured to the deck.

3. The swimming pool ladder as defined in claim 1 wherein each roller of said second pair of rollers is journaled on a horizontal frame member secured to the lowermost of said steps.

4. The swimming pool ladder as defined in claim 1 wherein each of said handrails includes a vertically extending upper portion secured to said platform and extending upwardly therefrom, a horizontal portion integral with said vertical upper portion, an inclined portion integral with said inclined portion, and a lower vertical portion integral with said inclined portion.

* * * * *